US009222734B2

(12) United States Patent
Ranes et al.

(10) Patent No.: US 9,222,734 B2
(45) Date of Patent: Dec. 29, 2015

(54) HEAT EXCHANGER TANK GROOVE GEOMETRY

(75) Inventors: Thomas Eric Ranes, Clawson, MI (US); Dwayne Robert Taylor, Livonia, MI (US); Christopher Lashay Zuber, Redford, MI (US)

(73) Assignee: Denso International America, Inc., Southfield, MI (US)

( * ) Notice: Subject to any disclaimer, the term of this patent is extended or adjusted under 35 U.S.C. 154(b) by 957 days.

(21) Appl. No.: 13/342,244

(22) Filed: Jan. 3, 2012

(65) Prior Publication Data

US 2013/0168069 A1 Jul. 4, 2013

(51) Int. Cl.
*F28F 9/02* (2006.01)
*F28F 21/06* (2006.01)

(52) U.S. Cl.
CPC ..... *F28F 9/0224* (2013.01); *F28F 21/067* (2013.01); *F28F 2009/0292* (2013.01); *F28F 2225/08* (2013.01)

(58) Field of Classification Search
CPC ..... F28F 9/0202; F28F 9/0207; F28F 9/0209; F28F 9/0212; F28F 9/02; F28F 2225/00; F28F 2225/08; F28F 21/067; F28F 2009/0292; F28D 2021/0031
USPC ..... 165/906, 173, 175, 176
See application file for complete search history.

(56) References Cited

U.S. PATENT DOCUMENTS

| | | | | |
|---|---|---|---|---|
| 5,582,239 | A * | 12/1996 | Tsunoda et al. | 165/76 |
| 6,082,448 | A * | 7/2000 | Haussmann | 165/174 |
| 6,202,741 | B1 * | 3/2001 | Demuth et al. | 165/176 |
| 6,640,887 | B2 * | 11/2003 | Abell et al. | 165/175 |
| 6,899,167 | B2 * | 5/2005 | Martins et al. | 165/140 |
| 7,198,097 | B2 | 4/2007 | Powers et al. | |
| 7,255,160 | B2 * | 8/2007 | Wada et al. | 165/173 |
| 2002/0057941 | A1 * | 5/2002 | Nakajima et al. | 403/230 |

* cited by examiner

*Primary Examiner* — Tho V Duong
(74) *Attorney, Agent, or Firm* — Harness, Dickey & Pierce, P.L.C.

(57) ABSTRACT

A heat exchanger includes a plurality of tubes extending between two tank bodies. At least one tank body includes a crown portion. At least one groove is formed in the crown portion. In order to avoid the creation of a thinner wall section in the crown portion, the inner and outer surfaces that form the groove are offset from each other.

1 Claim, 3 Drawing Sheets

HEAT EXCHANGER TANK GROOVE GEOMETRY

FIELD

The present disclosure relates to tank bodies for heat exchangers. More particularly, the present disclosure relates to the geometry for grooves provided in the tank body that eliminate any reduction of thickness of the tank body.

BACKGROUND

This section provides background information related to the present disclosure which is not necessarily prior art.

Heat exchangers are used in automotive vehicles to heat or cool various components of the vehicle. Heat exchangers typically include a pair of fluid tanks, a plurality of tubes, a plurality of fins and a pair of support members. Each of the plurality of tubes extends between the pair of fluid tanks and each of the plurality of tubes defines one or more fluid passages that are in direct communication with a tank cavity defined by each of the fluid tanks. Each of the plurality of fins is disposed between adjacent tubes to increase the heat transfer area of the heat exchanger. The pair of support members are located on opposite sides of the stacked tubes and fins to provide support for the heat exchanger. Heat is transferred between a fluid flowing in the passages of the tubes between the fluid tanks and a fluid flowing over the tubes and fins.

The tank bodies that form the fluid tanks can be made from a variety of materials including metals and plastics. The specific material depends on the strength and/or temperature requirements for the heat exchanger. Plastic tank bodies have been utilized when the requirements permit and these plastic tank bodies reduce weight and costs while still providing the necessary strength and durability. In order to increase the stiffness of the plastic tank body, grooves are added to the molded plastic tank body. When the tank body has a uniform cross-section along its length, these grooves increase the stiffness without reducing the strength of the plastic tank body.

Some plastic tank bodies are designed with a crown surface which is at an angle with the longitudinal length of the plastic tank body. The crown surface is typically used to locate a fluid inlet for adding additional fluid to the heat exchanger. When a vertical groove is formed in the crown surface of the plastic tank body, the wall thickness of the plastic tank body is reduced at one side of the groove and the wall thickness is increased at the opposite side of the groove due to the intersection of the groove with the crown surface. The reduced wall thickness weakens the plastic tank body. In addition, the increased wall thickness could create molding voids due to the larger volume which needs to be filled with plastic during the molding process.

SUMMARY

This section provides a general summary of the disclosure, and is not a comprehensive disclosure of its full scope or all of its features.

The present disclosure provides a groove design for a plastic molded tank body that maintains the same thickness at the intersection of the groove and crown surface as the thickness of the normal wall of the tank body. This is accomplished by first keeping the tangent locations of the start of the inner and outer grooves constant to maintain the normal wall thickness and then offsetting the ends of the inner and outer grooves to provide a thicker wall at the base of the groove which increases the wall thickness at the intersection of the groove and the crown surface.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
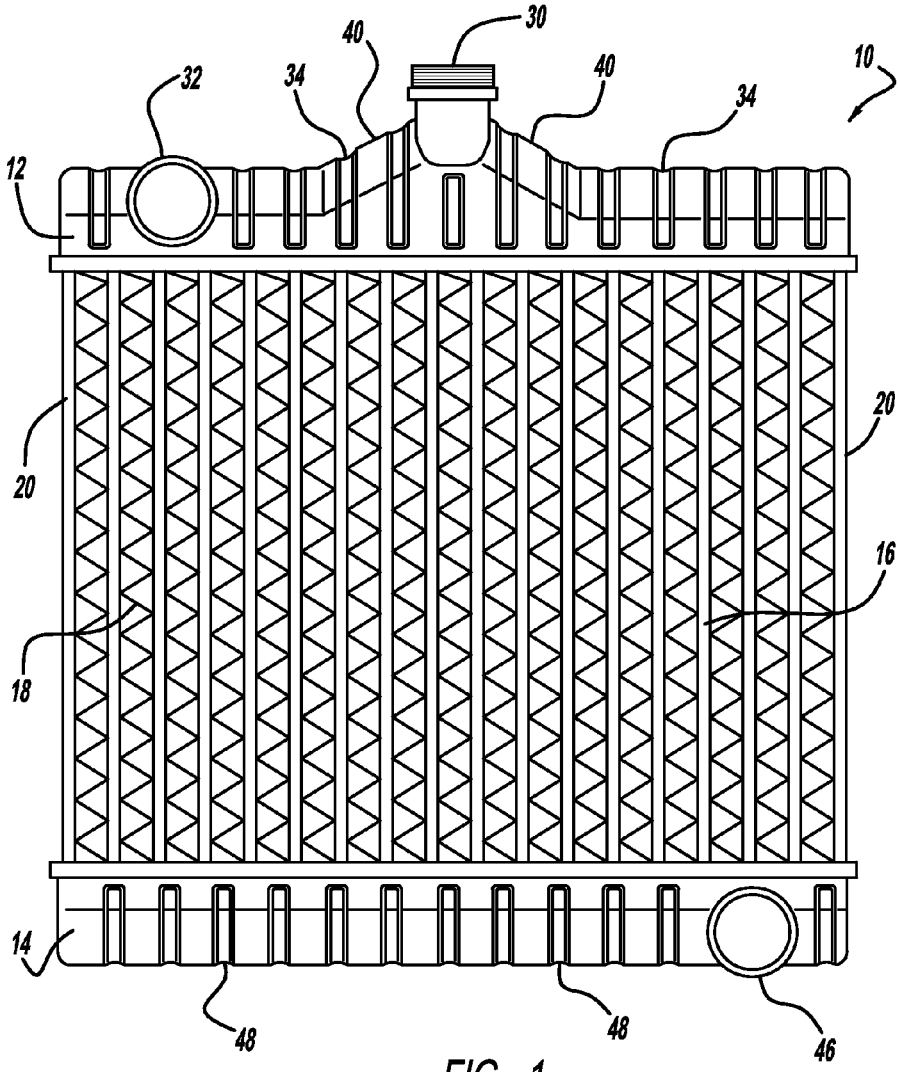
FIG. 1 is a front view of a heat exchanger in accordance with the present disclosure.

Referring to FIG. 1, a heat exchanger 10 is illustrated. Heat exchanger 10 comprises an upper tank body 12, a lower tank body 14, a plurality of tubes 16, a plurality of fins 18 and a pair of support members 20.

Each of the plurality of tubes 16 extend between upper tank body 12 and lower tank body 14. Each of the plurality of tubes 16 define one or more fluid passages that carry a working fluid between a chamber defined by upper tank body 12 and a chamber defined by lower tank body 14. Each of the plurality of fins 18 is disposed between adjacent tubes 16 and are bonded or brazed to the adjacent tubes 16. The plurality of fins 18 increase the area of the heat exchanger surface of heat exchanger 10 in order to increase the capacity and performance of heat exchanger 10. The pair of support members 20 are located at opposite sides of the stack of tubes 16 and fins 18 to increase the strength of the stacked components.

Figure 2:
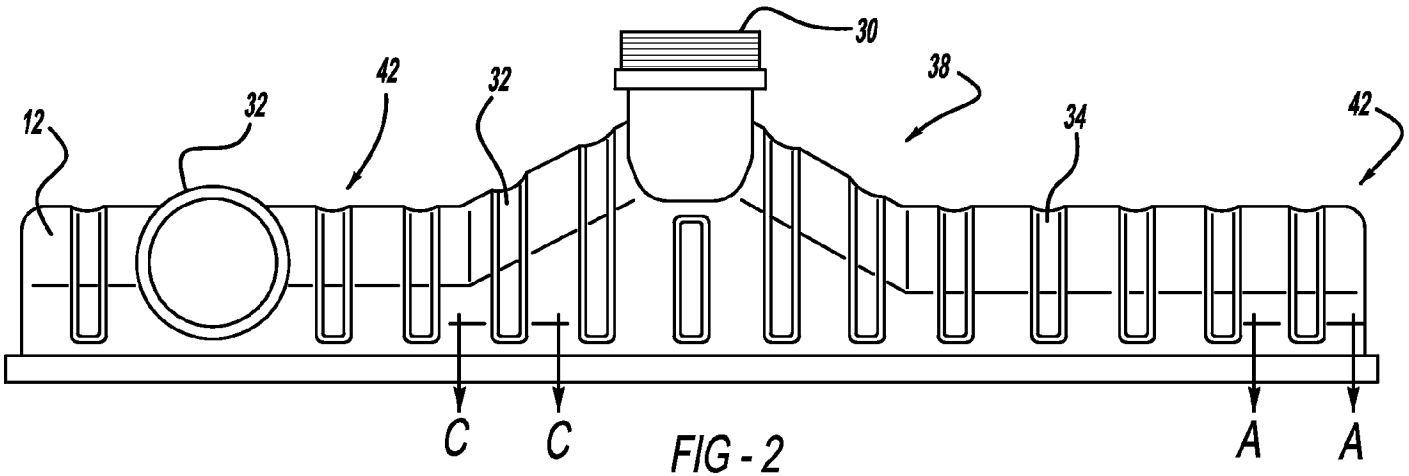
FIG. 2 is a side view of one of the tank bodies of the heat exchanger illustrated in FIG. 1.
Figure 3:
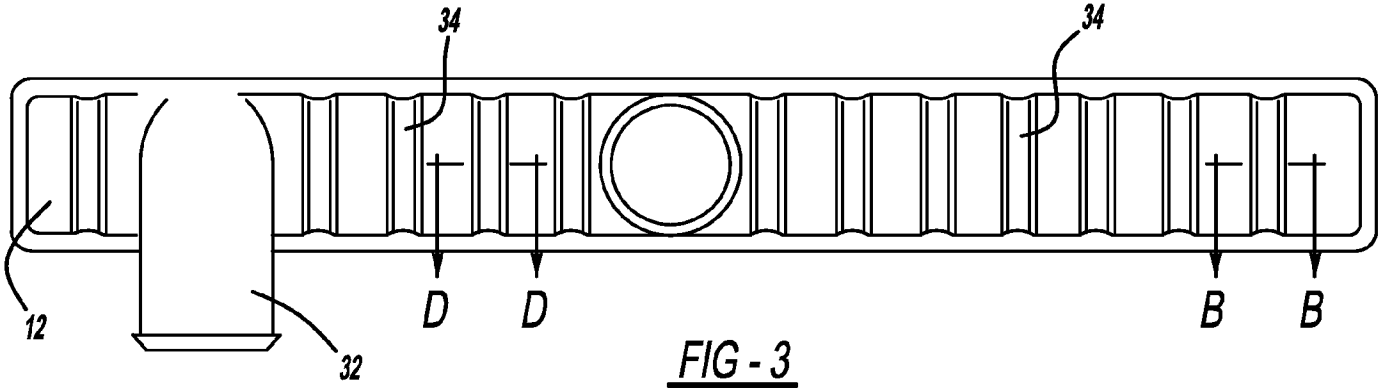
FIG. 3 is a top view of the tank body illustrated in FIGS. 1 and 2.

Referring to FIGS. 1-3, upper tank body 12 includes a filling port 30, a fluid inlet 32 and a plurality of grooves 34. The plurality of grooves 34 provide additional stiffness and support for upper tank body 12. Upper tank body 12 defines a crowned portion 38 at the center of upper tank body 12 where filling port 30 is located. The crowned portion 38 is defined by a pair of walls 40 that are angled upwards as illustrated in FIG. 1. On each side of crowned portion 38, upper tank body 12 defines a straight portion 42. Lower tank body 14 includes a fluid outlet 46 and a plurality of grooves 48. The plurality of grooves 48 provide additional stiffness and support for lower tank body 14. As an example, if heat exchanger 10 is a radiator for cooling an engine of a vehicle, the cooling system for the vehicle including heat exchanger 10 is filled with engine coolant through filling port 30. As the engine operates, an engine coolant pump pumps engine coolant through the engine. The engine coolant leaves the engine and is pumped to fluid inlet 32 of upper tank body 12. The engine coolant flows through upper tank body 12, through the plurality of tubes 16 and into lower tank body 14. From lower tank body 14, the engine coolant is supplied to the pump through fluid outlet 46. As the engine coolant flows through the plurality of tubes 16, it exchanges heat with air blown over the plurality of tubes 16 and the plurality of fins 18.

Figure 4:
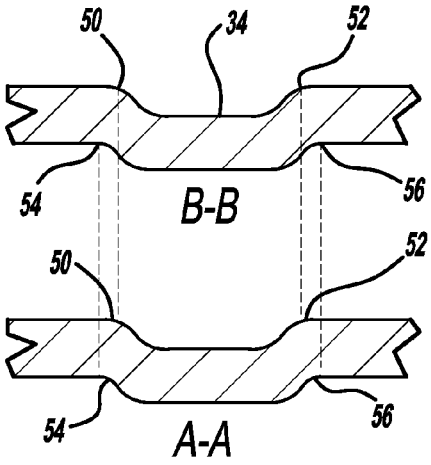
FIG. 4 is a schematic illustrating the relationship between a cross-section taken in direction A-A in FIG. 2 and a cross-section taken in direction B-B in FIG. 3.

Referring now to FIG. 4, a comparison of a cross-section of groove 34 taken in direction AA in FIG. 2 and a cross-section taken in direction B-B in FIG. 3 is illustrated. In FIG. 4, groove 34 is located in one of straight portions 42 of upper tank body 12. As illustrated in FIG. 4, groove 34 has an outer surface starting point 50, an outer surface ending point 52, an inner surface starting point 54 and an inner surface ending point 56. Inner surface starting point 54 is shifted from outer surface starting point 50 by a specified amount and inner surface ending point 56 is shifted from outer surface ending point 52 by the same specified amount in order to maintain the thickness of material through groove 34 the same as the thickness of material in non-grooved portion of upper tank body 12. The offset is the same between sections A-A and B-B because the two surfaces where these sections were taken are parallel, both being perpendicular to groove 34.

Figure 5:
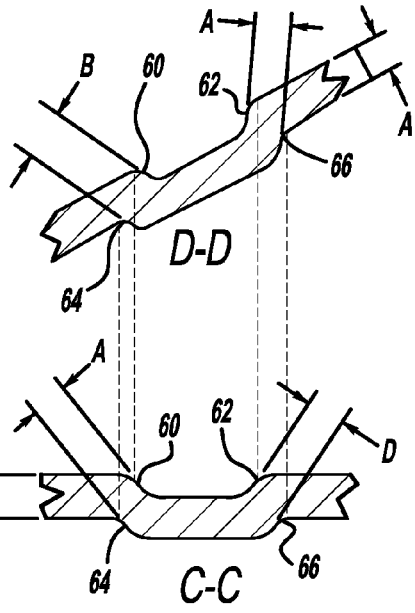
FIG. 5 is a schematic illustrating the relationship between a cross-section taken in direction C-C in FIG. 2 and a cross-section taken in direction D-D in FIG. 3.

Referring now to FIG. 5, a comparison of a cross-section of groove 34 taken in direction C-C in FIG. 2 and a cross-section taken in direction D-D in FIG. 3 is illustrated. In FIG. 5, groove 34 is located in crowned portion 38 of upper tank body 12. As illustrated in FIG. 5, groove 34 has an outer surface starting point 60, an outer surface ending point 62, an inner surface starting point 64 and an inner surface ending point 66. Inner surface starting point 64 is shifted from outer surface starting point 60 by a first specified amount and inner surface ending point 66 is shifted from outer surface ending point 62 by a second specified distance where the second specified distance is different than the first specified distance. This difference has the effect of offsetting the inner surface and outer surface of groove 34 in order to keep the thickness of material in groove 34 the same or greater than the thickness of material in non-grooved portion of crowned portion 38 of upper tank body 12 and thus avoid weakening upper tank body 12.

Inner surface starting point 64 is shifted from outer surface starting point 60 by the first specified distance and the first specified distance is determined such that the thickness A of material through the bent section after outer and inner surface starting points 60 and 64 in section C-C is maintained the same as the thickness A of material in the non-grooved portion of upper tank body 12. As illustrated in FIG. 5, due to the inclined surfaces of crowned portion 38, the thickness B of material in section D-D at the bent section after outer and inner surface starting points 60 and 64 of groove 34 is increased in crowned portion 38 as compared to thickness A in section C-C.

Inner surface ending point 66 is shifted from outer surface ending point 62 by the second specified distance and the second specified distance is determined such that the thickness A of material through the bent section before outer and inner surface ending points 62 and 66 in section D-D are maintained the same as the thickness A of material in the non-grooved portion of upper tank body 12. As illustrated in FIG. 5, due to the inclined surfaces of crowned portion 38, the thickness D of material in section C-C through the bent section before outer and inner surface ending points 62 and 66 of groove 34 is increased in crowned portion 38 as compared to section D-D. This has the effect of offsetting the inner surface of groove 34 with respect to the outer surface of groove 34.

Figure 6:
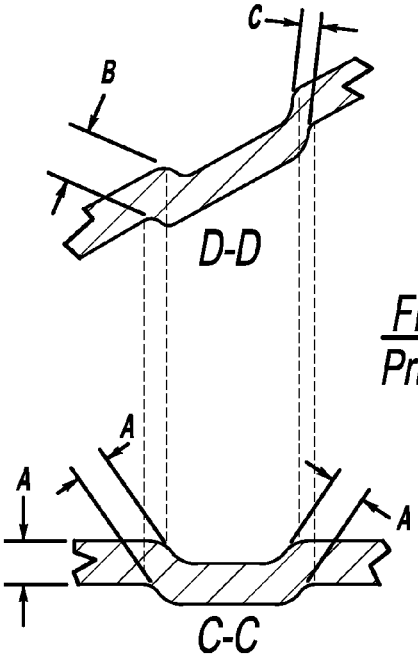
FIG - 6 Prior Art
FIG. 6 is a schematic similar to FIG. 5 but illustrating a prior art tank body.

FIG. 6 illustrates the prior art designs where the inner and outer surfaces of groove 34 are not offset as in the present invention. In FIG. 6, section C-C has both the thickness A through the bent section before outer and inner surface starting points 60 and 64 and through the bent section before outer and inner surface ending points 62 and 66. These thicknesses A are maintained the same as the thickness A of material in a non-grooved portion of upper tank body 12. Due to the inclined surface of crowned portion 38, the thickness B of material in section D-D through the bent section after surface starting points 60 and 64 of groove 34 is increased in crowned portion 38 as compared to thickness A in section C-C. Due to the inclined surface of crowned portion 38, the thickness C of material in section D-D through the bent section before surface ending points 62 and 66 of groove 34 is decreased in crowned portion 38 as compared to thickness A in section C-C. This decreased thickness represents a weakened area of upper tank body 12. This weakened area is eliminated by the offsetting of the inner surface with respect to the outer surface of groove 34.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A heat exchanger comprising:

a plurality of tubes, each tube defining at least one fluid passage;

a first tank body disposed at a first end of said plurality of tubes, each of the at least one fluid passages being in fluid communication with a first chamber defined by the first tank body;

a second tank body disposed at a second end of said plurality of tubes, each of the at least one fluid passages being in fluid communication with a second chamber defined by the second tank body, the second tank body comprising:

a filling port;

first and second angled walls extending from opposite sides of the filling port towards the first tank body, each of the first and second angled walls including a grooved portion and a non-grooved portion, a grooved thickness throughout an entirety of the grooved portions is at least as great as a non-grooved thickness of the non-grooved portions;

a crown portion including the filling port, the first angled wall, and the second angled wall;

a first planar wall extending from the first angled wall in a first direction generally parallel to the first tank body and away from the filling port; and a second planar wall extending from the second angled wall in a second direction generally parallel to the first tank body and away from the filling port, the second direction is generally opposite to the first direction.

* * * * *